US006412452B1

(12) United States Patent
Bertsch et al.

(10) Patent No.: US 6,412,452 B1
(45) Date of Patent: Jul. 2, 2002

(54) LIQUID COOLED CYLINDER HEAD

(75) Inventors: Ulrich Bertsch, Burgstetten; Carsten Funke, Kernen, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/625,556

(22) Filed: Jul. 25, 2000

(30) Foreign Application Priority Data

Aug. 6, 1999 (DE) ..... 199 37 122

(51) Int. Cl.[7] ..... F02F 1/36
(52) U.S. Cl. ..... 123/41.82 R
(58) Field of Search ..... 123/41.82 R, 41.82 A, 123/41.31

(56) References Cited

U.S. PATENT DOCUMENTS 5,720,240 A * 2/1998 Dohn et al. ..... 123/41.82
5,799,627 A * 9/1998 Dohn et al. ..... 123/41.82

FOREIGN PATENT DOCUMENTS

DE 195 42 492 C1 1/1997

* cited by examiner

*Primary Examiner*—Tony M. Argenbright
*Assistant Examiner*—Katrina B. Harris
(74) *Attorney, Agent, or Firm*—Klaus J. Bach

(57) ABSTRACT

In an internal combustion engine, with a cylinder head having a coolant space associated with each combustion chamber, wherein the coolant space comprises, for each cylinder of the engine, a first coolant chamber and a second coolant chamber separate from one another, the coolant space has a coolant inlet which extends to the outside and is connected to a coolant supply line for directly supplying coolant from the outside to the first and second coolant chambers.

10 Claims, 2 Drawing Sheets

LIQUID COOLED CYLINDER HEAD

BACKGROUND OF THE INVENTION

1. Field of the Invention.

The invention relates to a cylinder head of an internal combustion engine, with a coolant space associated with each combustion chamber of the cylinderhead and with at least one coolant inlet and at least one coolant outlet.

2. Description of Related Art.

A coolant arrangement for a multi-cylinder internal combustion engine is disclosed in German DE 195 42 492 C1. In this coolant arrangement, a coolant space includes a plurality of coolant space areas provided for a combustion chamber of the engine. The coolant space is defined between the base of the cylinder head, the outer walls, and the top of the cylinder head. The coolant space areas are supplied with coolant through inlets in communication with the coolant jacket of the engine block. The individual coolant space sections are flow connected in series with the coolant jacket of the cylinders and thus cannot be individually subjected to different flow patterns or be supplied with coolant differently.

SUMMARY OF THE INVENTION

The object of the invention is to provide a coolant housing with individual coolant spaces in a manner so that each individual coolant space or section can be subjected to a different flow or can be supplied separately with coolant to a different degree. Thus, coolant can be supplied separately to critical regions for individual cylinders.

The object is achieved by including providing in the cylinderhead at least a first coolant chamber and at least a second coolant chamber, which are separate from one another. The coolant outlet of the second coolant chamber is in communication with the first coolant chamber. This permits directing coolant flow inside the coolant spaces in an optimized manner to specifically cool critical (hot) regions, such as the center of the combustion chamber and the area adjacent the exhaust valve(s).

It is furthermore possible to arrange the coolant inlet of the second coolant chamber exterior to the coolant housing and to provide for a coolant outlet of the second coolant chamber in the coolant space of the cylinderhead.

Furthermore, it has been found that it is desirable that the coolant outlet of the second coolant chamber be designed as a coolant flow passage arranged near an exhaust valve. The design of the coolant outlet as a transverse flow passage subjects the critical (hot) region near the exhaust valve and the combustion chamber to coolant flow providing for specific cooling in these critical regions.

To this end, it is also advantageous that the coolant inlet and outlet of the first coolant chamber of the coolant housing are positioned exteriorly to the coolant housing. The two coolant chambers or the coolant space can therefore be subjected to different flow patterns in different areas of the cylinderhead for cooling them in a specific manner.

Finally, in a preferred embodiment of the invention, provision is made for the coolant inlet to be in communication with both the first and the second coolant chamber. In this way, both coolant chambers are jointly supplied with coolant.

Therefore, the coolant chambers of the cylinder head are entirely separate from the coolant spaces of the engine block.

In the manufacture of the subject cylinderhead with coolant spaces, sand cores are configured in accordance with the shape of the coolant spaces. This design does not require additional bores or machining steps for the forming of the coolant spaces. Accordingly, a cylinderhead with cooling chambers as provided by this invention are substantially more cost-effective from a casting point of view.

Of particular importance for the present invention is the use of an external valve at the inlet of the first and second coolant chambers. By means of the valve, the coolant space can be supplied with separate or individualized flows in accordance with the desired cooling capacity.

In connection with the design and arrangement of the subject invention, it is of advantage if the top of the first coolant chamber is disposed approximately level with the top of the combustion chamber.

Furthermore, it is advantageous to locate the second coolant chamber near an outer end of the first coolant chamber and near the exhaust side of the cylinderhead. This permits additional coolant flow to be supplied near this critical hot exhaust side.

In addition, it is advantageous to provide flow conducting or flow directing elements for the coolant to ensure an optimized flow pattern inside the cooling chambers.

Furthermore, it is advantageous for the first and the second cooling chambers of a combustion chamber to have a common coolant inlet. Then, depending on the particular requirements of an internal combustion engine, individual coolant chambers may be supplied with individual coolant flows or with a combined flow. Also, the coolant outlet of the second coolant chamber should conduct coolant past the combustion chamber top portion and past the center of the combustion chamber.

For simplification, the coolant spaces of any two adjacent combustion chamber areas should have a common coolant inlet and a common coolant outlet.

Advantages and details of the invention are illustrated in the following drawings and described in the following detailed description on the basis of the accompanying drawings.

DESCRIPTION OF THE PREFERRED EMBODIMENT

Figure 1:
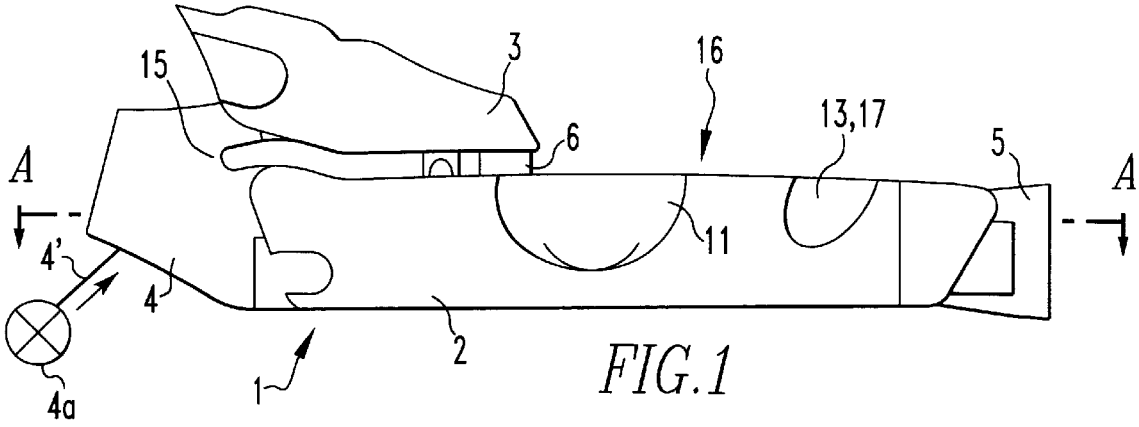
FIG. 1 is a schematic side view of a coolant housing area defining coolant spaces.
Figure 2:
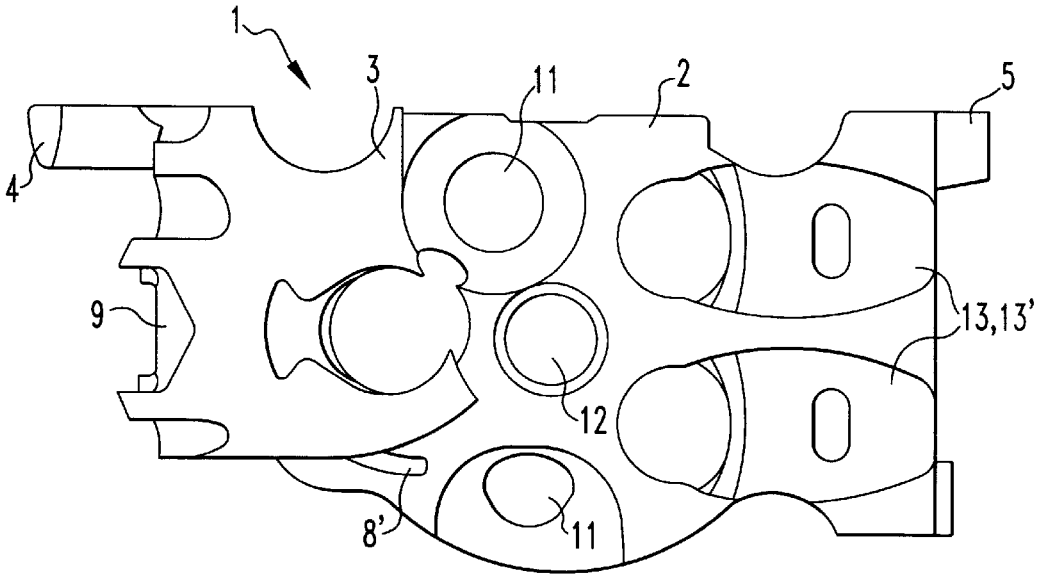
FIG. 2 is a schematic top planar view of the coolant spaces formed in the cylinderhead.
Figure 3:
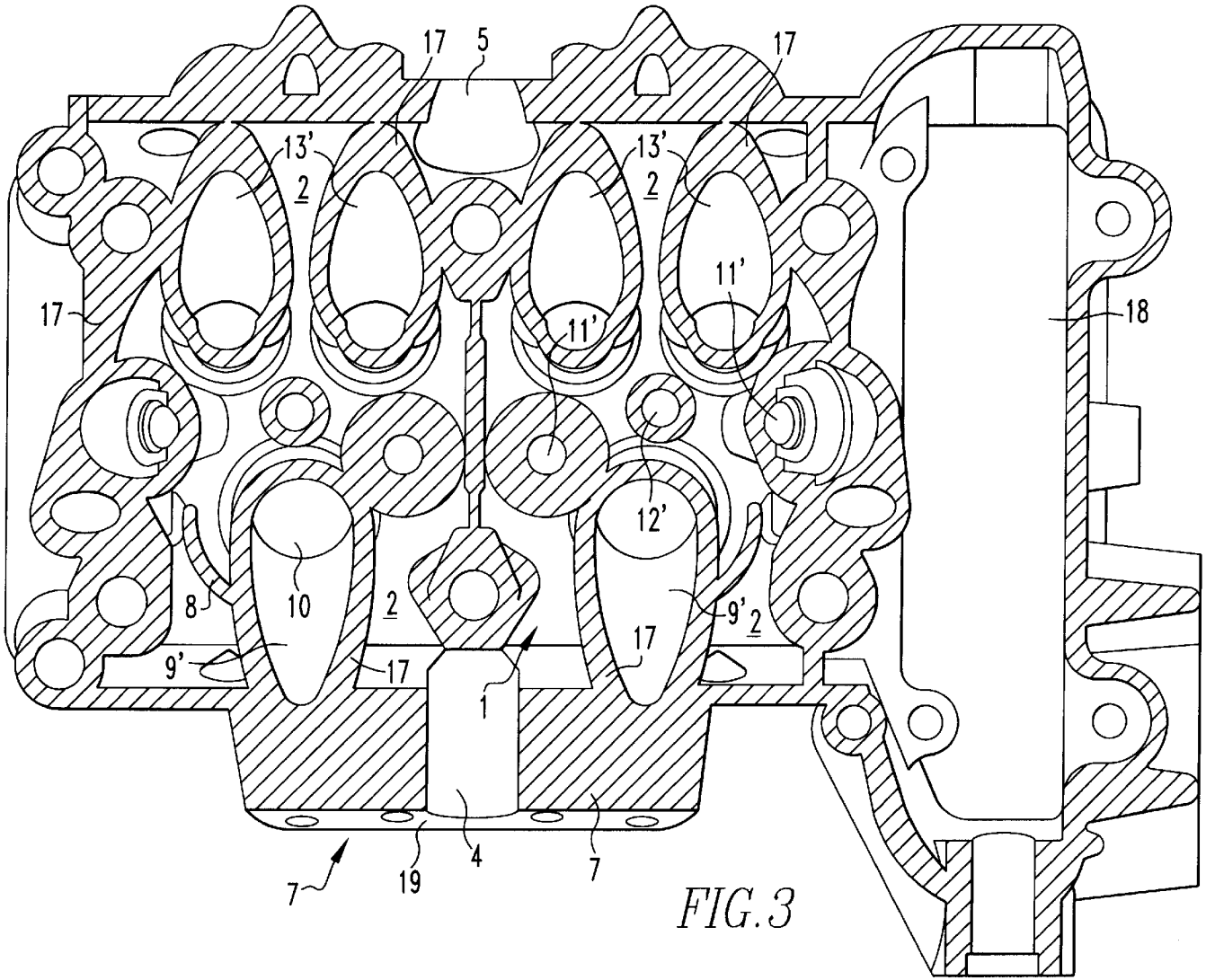
FIG. 3 shows a sectional representation of the coolant housing defining coolant spaces taken along section line A—A in FIG. 1.

In the drawings, a coolant space 1 for a cylinder head (not shown in the drawing) of a multi-cylinder internal combustion engine is shown. The coolant space 1 consists of a first coolant chamber 2 and a second coolant chamber 3, both chambers being part of a coolant housing 7. What is shown in FIGS. 1 and 2 are actually the coolant spaces or, when filled with coolant, the coolant bodies in the cylinderhead. These coolant spaces as shown in FIG. 3 include over each cylinderhead first and second coolant chambers 2 and 3, which have about the same height.

The first coolant chamber 2 and the second coolant chamber 3 have a common coolant inlet 4. A branch passage 15 beginning just after entry into the coolant housing 7 supplies coolant to the first coolant chamber 2 and the second coolant chamber 3.

The coolant inlet 4 is designed as an external inlet, i.e. it opens to the outside of the coolant housing, that is, the cylinderhead. In this case, coolant is not supplied to the cylinder head's cooling circuit through the conventional openings in the base of the cylinder head but instead, via an external inlet 4 formed in the cylinder head. A coolant valve 4*a* assigned to at least one of the inlet lines 4' leading to the external coolant inlets 4. The valve provides a simple control of coolant flow into the respective coolant spaces associated with specific cylinders.

The second coolant chamber 3 is disposed over the top side 16 of the first coolant chamber and is provided with a coolant passage 6 which serves as a coolant outlet. Coolant flows transversely through the second coolant chamber 3 and leaves via the coolant passage 6, which is arranged adjacent the region of aperture 10 defining an exhaust passage. This provides for precise cooling of the critical region adjacent the exhaust valve or around the exhaust passage and at the top of the combustion chamber.

As seen in FIG. 2, the second coolant chamber 3 of the coolant space 1 is located above the first coolant chamber 2 in the exhaust side region. Apart from the coolant passage 6 and the coolant inlet 4, the second coolant chamber 3 has no further fluid connection to the first coolant chamber 2. Importantly for the second coolant chamber 3, it conducts coolant about and around the exhaust valve aperture 10 provided for an exhaust valve (not shown).

The first coolant chamber 2 of the coolant space 1 has a coolant outlet 5 designed as a coolant passage with coolant flowing longitudinally through it. Various apertures 9, 10, 11, 12, 13 are provided respectively: for an outlet for exhaust gas; an exhaust valve; a spark plug; a fuel injector; and an inlet valve. The coolant flows around the walls defining these apertures before it leaves the coolant chamber via the coolant outlet 5.

The coolant outlet 5 is an external coolant outlet, i.e. it opens externally of the coolant housing 7. It is in communication with the inlet of the engine's coolant pump via conduits or lines (not shown).

In addition to the coolant inlet 4, the second coolant chamber's coolant passage 6 conducts coolant also to the first coolant chamber 2.

As best understood by referring to FIG. 3, two coolant spaces 1 are associated with two adjacent cylinders or combustion chambers. The two coolant spaces form a pair for the two cylinders or pairs of coolant spaces for various even numbers of cylinders, which are arranged side by side in a cylinderhead 7. Two adjacent coolant spaces 1 of a coolant-space pair are connected via a common coolant inlet 4 and a common coolant outlet 5 but there is no flow connection between the adjacent pairs of coolant spaces. Each cylinder pair or each coolant-space pair is therefore cooled and subjected to a separate coolant flow pattern.

FIG. 1 shows that the first coolant chamber 2 and the second coolant chamber 3 of the coolant space 1 are arranged separately from one another, and only the common coolant inlet 4 and the coolant passage 6 provide for communication between the two chambers.

FIG. 2 shows the coolant space 1 with the various apertures 9, 11, 12, 13 respectively, for the exhaust gas outlet (and exhaust valve), the spark plugs, the fuel injector, and the intake air to the combustion chamber (and intake valve).

FIG. 3 shows, in a top view, the coolant housing 7 including walls 17, an inlet flange 19 for a coolant-space pair, and a timing chain housing 18.

FIGS. 1 and 2 only show the coolant space 1, FIG. 3 shows the cylinderhead with the coolant chamber 2 in a section taken along line A—A of FIG. 1. The walls 17 of the cylinderhead structure 7 form the coolant space 1.

In this representation of the invention, the first coolant chamber 2 is sectioned along line A—A in FIG. 1. The common coolant inlet 4 supplies two coolant spaces 1 for two adjacent cylinders. Coolant from the first and second coolant chambers 2, 3 flows out via the coolant outlet 5. Exhaust passages 9' for exhaust gas, inlet passages 13' for the engine charge air, and openings 11' for receiving spark plugs and also an opening 12' for receiving a fuel injector are provided.

Within the coolant chamber 2, a curved flow guide element 8 is provided adjacent the exhaust passage 9' or, respectively, disposed with one end adjacent the exhaust passage 9'.

What is claimed is:

1. A cylinderhead of an internal combustion engine having at least one combustion chamber with a coolant space disposed in said cylinderhead for each engine combustion chamber, each coolant space having at least one coolant inlet and at least one coolant outlet, and each coolant space comprising a first coolant chamber and a second coolant chamber separate from said first coolant chamber, said coolant inlet extending to the outside of said cylinderhead and being connected to a coolant supply line for supplying coolant directly to said coolant chambers.

2. A cylinderhead according to claim 1, wherein said second coolant chamber has a coolant outlet, which is fluidly connected to said first coolant chamber.

3. A cylinderhead according to claim 1, wherein the coolant inlet chamber opens at the exterior and the coolant outlet of said second coolant chamber is located adjacent the central region of the combustion chamber.

4. A cylinderhead according to claim 1, wherein said cylinderhead includes an exhaust gas passage and said coolant outlet of the second coolant chamber is located adjacent to said exhaust passage so as to provide for intense cooling of said exhaust passage.

5. A cylinderhead according to claim 1, wherein the coolant inlet is in flow connection with said first coolant chamber and said second coolant chamber.

6. A cylinderhead according to claim 1, wherein at least one valve is provided for controlling the coolant flow to the coolant inlet of the first coolant chamber and the second coolant chamber.

7. A cylinderhead according to claim 1, wherein at least one valve is provided for controlling the coolant flow to the coolant inlet of the first coolant chamber and the second coolant chamber.

8. A cylinderhead according to claim 1, wherein said second coolant chamber is disposed at the exhaust valve side of said cylinderhead.

9. A cylinderhead according to claim 1, wherein a flow-directing wall elements extends in said first coolant chamber from a wall portion defining said exhaust gas passage for directing coolant flow toward said wall portion.

10. A cylinderhead according to claim 1, wherein coolant spaces of adjacent combustion chambers share a common coolant inlet and a common coolant outlet.

* * * * *